US006260525B1

(12) United States Patent
Moyer

(10) Patent No.: US 6,260,525 B1
(45) Date of Patent: Jul. 17, 2001

(54) ENGINE VALVE DISABLER

(76) Inventor: David F. Moyer, 5 Weatherby Rd., Hanover, NH (US) 03755-1923

( * ) Notice: Subject to any disclaimer, the term of this patent is extended or adjusted under 35 U.S.C. 154(b) by 0 days.

(21) Appl. No.: 09/519,635

(22) Filed: Mar. 6, 2000

(51) Int. Cl.[7] ..... F01L 1/34

(52) U.S. Cl. ..... 123/90.16; 123/198 F; 477/189

(58) Field of Search ..... 123/90.11, 90.14, 123/90.15, 90.16, 90.43, 552, 198 F, 480, 406.23, 406.32; 477/186, 189

(56) References Cited

U.S. PATENT DOCUMENTS

| | | | | |
|---|---|---|---|---|
| 3,969,614 | * | 7/1976 | Moyer et al. | 123/480 |
| 4,094,275 | * | 6/1978 | Auiler et al. | 123/552 |
| 4,222,354 | | 9/1980 | Uitvlugt . | |
| 4,227,494 | | 10/1980 | Uitvlugt . | |
| 4,230,076 | | 10/1980 | Mueller . | |
| 4,256,070 | | 3/1981 | Mueller . | |
| 4,777,915 | | 10/1988 | Bonvallet . | |
| 4,857,003 | * | 8/1989 | Hafner et al. | 123/90.16 |
| 5,529,549 | * | 6/1996 | Moyer | 477/189 |
| 5,544,626 | | 8/1996 | Diggs . | |
| 5,653,198 | | 8/1997 | Diggs . | |
| 5,695,430 | * | 12/1997 | Moyer | 477/189 |
| 5,832,885 | * | 11/1998 | Moyer | 123/90.16 |
| 5,893,344 | * | 4/1999 | Church | 123/90.16 |
| 5,975,052 | * | 11/1999 | Moyer | 123/406.23 |
| 5,992,390 | * | 11/1999 | Moyer | 123/198 F |
| 6,006,706 | * | 12/1999 | Kanzaki | 122/90.16 |
| 6,062,201 | * | 5/2000 | Nozawa et al. | 123/90.16 |

* cited by examiner

*Primary Examiner*—Teresa Walberg
*Assistant Examiner*—Fadi H. Dahbour

(57) ABSTRACT

A method for improving efficiency and reducing emissions of an internal combustion engine. Variable displacement engine capabilities are achieved by disabling engine valves during load changes and constant load operations. Active cylinders may be operated at minimum BSFC by intermittently disabling other cylinders to provide the desired net torque. Disabling is begun by early closing of the intake valve to provide a vacuum at BDC which will result in no net gas flow across the piston rings, and minimum loss of compression energy in the disabled cylinder; this saving in engine friction losses is significant with multiple disablements.

15 Claims, 2 Drawing Sheets

ENGINE VALVE DISABLER

CROSS REFERENCE

This application is an improvement of the valve disabler described in my U.S. Pat. No. 5,832,885 issued Nov. 10, 1998. It is incorporated herein by reference.

1. Field of the Invention

The present invention relates to the field of internal combustion engines; more particularly to a method of controlling the engine intake and exhaust valves so as to produce a more efficient combustion process within the cylinder.

2. Background of the Invention

This invention describes a method for increasing the efficiency and reducing the undesirable emissions of an internal combustion engine. While the general principles and teachings disclosed are applicable to all combustion engines, the invention is hereinafter described in detail in connection with its application to a reciprocating, fuel injected, spark ignited, multi-cylinder engine.

As used herein, the term "engine" refers to a device which converts heat energy, released by the combustion of a fuel, into mechanical energy in a rotating output shaft of the engine. Also, the term "disabled cylinder" is defined as having the intake and exhaust valves of a cylinder disabled so that they remain closed while the crankshaft is rotating. These valves may be poppet valves driven by a camshaft common to such engines or any other valves which admit or discharge a gaseous mixture to or from the cylinder. Also, the term "brake specific fuel consumption" or "BSFC" is defined as the amount of fuel consumed to deliver a given energy to the engine drive shaft.

In the United States, the law requires that many types of vehicles must be tested over a specified driving cycle (EPA test) while the fuel consumed and the exhaust emissions generated are measured. This driving cycle has many periods of acceleration, deceleration and idle, with few periods of steady speed, and is intended to reflect typical urban vehicle usage. During deceleration and idle operation it is difficult to control emissions in typical internal combustion engines—particularly throttled engines because of the low manifold pressures at these times. Also, when the accelerator pedal is released, fuel continues to be consumed even though no energy is required from the engine. The emissions measured during this test must be less than those specified by law at the time of manufacture, and the fuel consumed is used in the determination of the vehicle manufacturer's corporate average fuel economy (CAFE).

DESCRIPTION OF THE PRIOR ART

The poppet valve driven by a camshaft has been used in the internal combustion engine for many years. Modifications to the valvetrain have been developed to permit changing the valve timing while the engine is in operation. When the timing control prevents the valves from opening during an engine cycle, the cylinder is disabled, and the effect of a variable displacement engine is obtained. The advantage of a variable displacement engine is that when less than maximum efficiency power is required, some of the cylinders may be disabled and the remaining active cylinders' power is increased so that they will operate at greater efficiency, while the engine output remains constant. This approach has had limited success in practice because the usual control activates or deactivates half the number of cylinders, and this abrupt change in output torque causes poor drivability. Furthermore, the disabling mechanism is relatively slow acting so that more than one revolution of the crankshaft is required to make the change.

All of the differences cited with the prior art referenced in my previous patent (5,832,885) apply to the present invention.

Martin W. Uitvlugt in U.S. Pat. Nos. 4,222,354 and 4,227,494 describes a disabler having a solenoid actuator which disables two engine valves simultaneously only when both valves are closed. The present invention disables the valves individually and can do so whether the engine valve is open or closed. The solenoid of the Uitvlugt disabler must have the power to overcome the friction, spring forces, and inertia of the disabling mechanism in order to disable the two valves. The present invention only requires the solenoid to provide a sealing force for the magnetic circuit since the disabler spring always closes that circuit when the cam lobe has rotated beyond the maximum actuation point.

Robert S. Mueller in U.S. Pat. No. 4,230,076 describes an improvement of the Uitvlugt patents which couples an additional pair of valves to the 1 pair control system. In U.S. Pat. No. 4,256,070, he provides means for utilizing the cyclic forces of the camshaft to power part of the disabling mechanism. This adds friction, spring forces, and inertia to the camshaft load. Further, it adds a delay to the start of disabling because the camshaft must first actuate the mechanism to begin disabling. This means the initial acceleration normally applied to the valve by the cam lobe is applied to the disable assembly when the valve is enabled. In the present invention, the disable spring, which is compressed by the cam during each disabled cycle, closes the magnetic circuit. When the valve is enabled, the enabling solenoid does not need to move anything, it merely seals the magnetic circuit. Further, since the disable spring is weaker than the valve spring, the work load on the camshaft is less rather than more than the normal load.

D. J. Bonvallet in U.S. Pat. No. 4,777,915 describes a disabler mechanism consisting of one solenoid to open the engine valve, and another solenoid to close the same valve. Here again, much electrical power is required because the stroke to open the exhaust valve must begin against the exhaust pressure at bottom dead center (BDC), and the solenoids must power all the repetitive valve operations.

M. B. Diggs in U.S. Pat. No. 5,544,626 uses a solenoid to cause a pin to interfere with the compression of a disabler spring. Although the solenoid is not required to compress the valve spring, it cannot interfere once the disabler spring compression has begun. To disable the valve while the cam lobe is compressing the valve spring requires a strong solenoid. Thus, control of valve overlap, throttling, and exhaust gas recirculation would use more power than in the present invention. The same comments apply to his improvements in U.S. Pat. No. 5,653,198, where there are more components having additional mass.

OBJECTS AND ADVANTAGES

The main object of this invention is to improve the fuel efficiency and reduce the undesirable emissions of the internal combustion engine while powering a vehicle in normal operating conditions. This object is accomplished by varying the timing of the engine intake and exhaust valves. These valves are opened and closed rapidly by the camshaft and the timing of their closure is controlled by a computer which calculates the optimum timing. The computer adjusts the valve timing based upon operator demands and stored engine data to produce maximum fuel efficiency with adequate emission control, uniform engine temperature, and smooth engine operation. This valve control also eliminates the need for the throttle and exhaust gas recirculation valve and their attendant contribution to engine losses.

The object is further accomplished by discontinuing the fuel flow and disabling all the cylinders whenever the accelerator pedal is released and the engine is above idle speed. With no fuel, the engine generates no emissions during this period. When a cylinder is disabled, its intake valve is closed before the end of the intake stroke so that there is enough vacuum when the piston reaches bottom dead center (BDC) that the product of pressure across the piston rings and time integrates to zero. This results in a much lower peak pressure in the disabled cylinder at top dead center (TDC) and reduced friction losses. In order to maintain drivability while achieving the fuel savings, it is necessary for the computer to control the pattern of the disabled and enabled cylinders to insure a quiet, smoothly running engine. This requires a fast acting disabling mechanism with low power consumption and minimum noise.

The apparatus of the invention includes a conventional internal combustion engine, a controller (preferably a programmable digital computer), electrically controlled engine valves, an electrically controlled fuel injector for each cylinder, and an accelerator pedal position sensor. The invention may be better understood by reference to the detailed description and drawings which follow.

REFERENCE NUMBERS LIST

Figure 1:
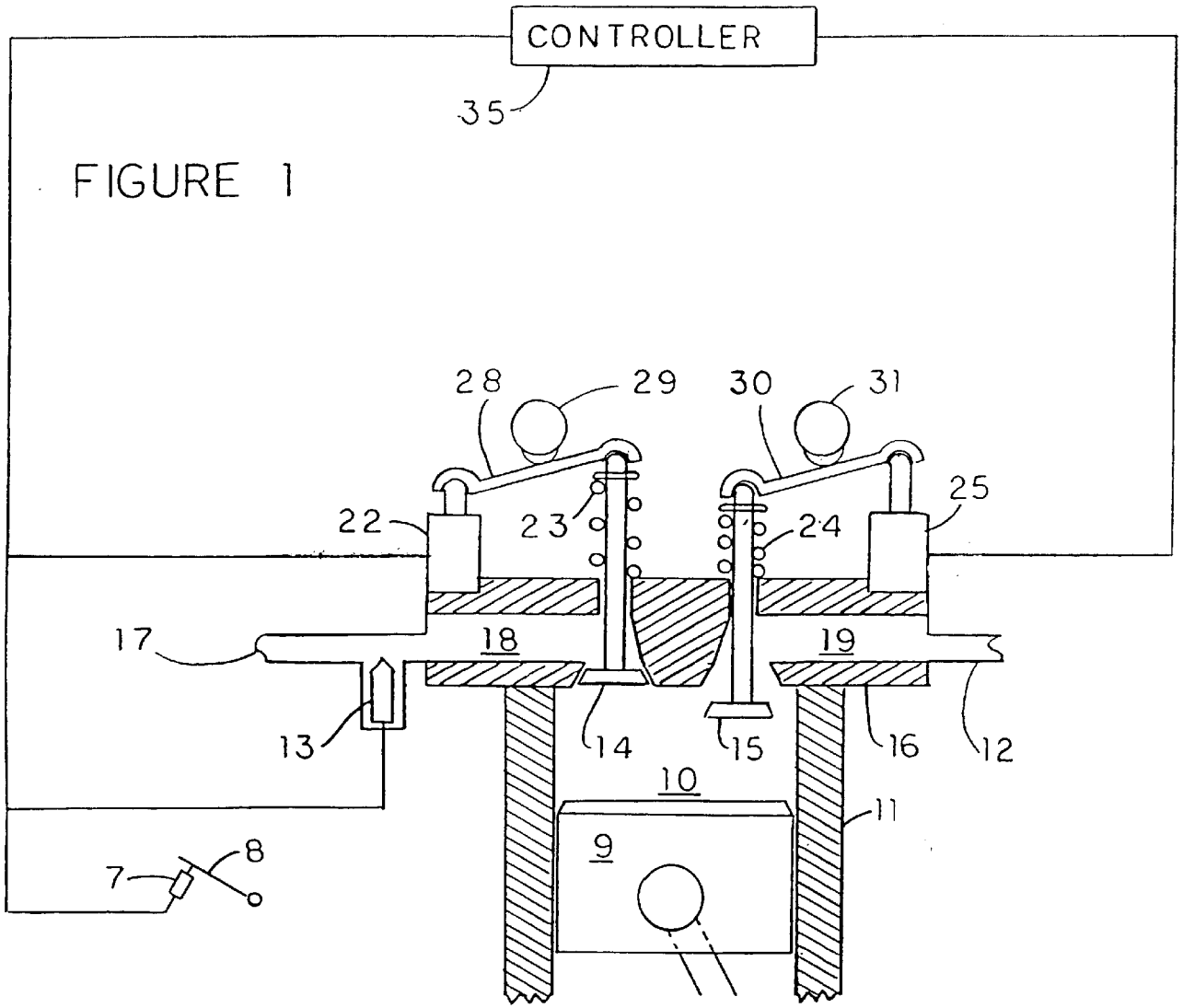
FIG. 1 is a schematic block diagram of the engine system of a reciprocating, fuel injected, spark ignited internal combustion engine with a cam-operated valve train having valve disablers.

1. Pin
2. Sleeve Bearing
3. Magnetic Stator
4. Electric Coil
5. Magnetic Clapper
6. Disabler Spring
7. Accelerator Sensor
8. Accelerator Pedal
9. Piston
10. Cylinder
11. Engine Block
12. Exhaust Line
13. Fuel Injector
14. Intake Valve
15. Exhaust Valve
16. Engine Head
17. Intake Line
18. Inake Manifold
19. Exhaust Manifold
22. Intake Valve Disabler
23. Intake Valve Spring
24. Exhaust Valve Spring
25. Exhaust Valve Disabler
28. Intake Rocker Arm
29. Camshaft Intake Cam
30. Exhaust Rocker Arm
31. Camshaft Exhaust Cam
35. Controller

SUMMARY

In the following description, the method and apparatus used to accomplish the objects of the invention are embodied in an engine control system applied to a reciprocating, multicylinder, fuel injected, spark ignited internal combustion engine. It should be understood, however, that the principles and approaches taken in connection with this particular type of engine are applicable to other types as well.

The engine valves are powered by the camshaft and are electrically controlled by means of a valve disabler. The disabler is interposed in the force transmission from the cam lobe to the engine valve spring which is holding the valve shut. The three most common means of that force transmission are: 1. direct from cam lobe to fixed spacer to valve stem to valve spring; 2. direct from lobe to center of a rocker arm to valve stem and spring at one end of the rocker arm with the other arm end on a fulcrum; 3. direct from lobe to a rocker arm end to valve stem and spring at other end of the rocker arm with the rocker arm center on a fulcrum.

In the present invention, the valve disabler replaces the spacer or the fulcrum and in response to an electric signal, changes from a fixed length to a spring. This disabler spring, having a lower spring force than the valve spring, is compressed by the lobe force. This compression absorbs the lobe travel while transmitting a force to the valve spring which is less than the force of the valve spring holding the valve closed. Hence, the valve is disabled from responding to the cam lobe force and does not open.

The minimum BSFC usually occurs in a conventional engine with wide open throttle and a stochiometric air/fuel ratio (that mixture of fuel and air whereby there is exactly enough air to supply the oxygen to burn all the fuel). However, when a cylinder is disabled, the engine minimum BSFC is improved because the disabled cylinder returns the power absorbed on the compression stroke by the expansion stroke which follows, i.e., a pneumatic spring. The active cylinders lose the compressed air energy in blowdown during the exhaust stroke.

When a cylinder is disabled, it is best done by closing the intake valve early in the intake stroke so as to have a cylinder vacuum at bottom dead center (BDC). The point of closure is dependent upon the cylinder dimensions, but the result of the vacuum is to have a pressure differential (cylinder pressure minus crankcase air pressure) across the piston rings which, integrated over the piston stroke, will net out to zero gas flow. This means no crankcase oil will be sucked into the cylinder, and also, the compression work of disablement will not be lost. If the disablement occurs when the cylinder is full of atmospheric air after intake, or worse, full of exhaust under greater pressure, the pressure differential will result in leakage past the rings until the vacuum described above is attained. On each compression stroke, some of the air and hence some of the disablement compression energy will be lost. When the disablement is rotated among the cylinders to achieve uniform temperature and smooth operation, that lost disablement energy can be significant since disablement occurs frequently.

If the camshaft is designed for maximum exhaust valve overlap but minimum intake valve overlap, then overlap may be controlled by earlier closing of the exhaust valve. Even earlier exhaust valve closing will result in exhaust gas retention for reduction of the oxides of nitrogen emissions, eliminating the need for an exhaust gas recirculation (EGR) valve. In a like manner, early closing of the intake valve eliminates the need for a throttle.

Whenever the accelerator pedal is released, the computer disables all cylinders to reduce compression losses and stops fuel flow until the engine speed reaches the idle value. At that time, the computer activates the appropriate number of cylinders to generate the required idle power.

DESCRIPTION OF THE INVENTION

FIG. 1 shows a cross section of one cylinder 10 of a vehicle engine with engine block 11, which has a plurality of cylinders. A piston 9 is mounted for reciprocal motion within cylinder 10. A spark plug (not shown) ignites the fuel-air mixture in the usual fashion. Piston 9 is mechanically connected to a crankshaft (not shown) which transforms the reciprocal motion to rotary motion in the usual fashion. Also in the usual fashion, the crankshaft is connected to the wheels of the vehicle through a transmission and differential (not shown). Valve fulcrums 22 and 25 are used to provide engine valve control.

The inputs for controller 35 are an accelerator position sensor 7, and current engine system sensors (not shown). The outputs from controller 35 are an intake valve control 22, an exhaust valve control 25, fuel injector 13, and current engine controls (not shown).

During vehicle operation, when accelerator pedal 8 is depressed or released, controller 35 calculates the power required by the new position and looks in its memory for the torque needed for that power at the present engine speed. It then calculates the valve operations, fuel flow, and other engine variables, for a combination of cylinder firings at the lowest BSFC which will meet requirements of drivability, emissions, engine temperature distribution, and smooth engine operation. As engine speed changes in response to the change in power, controller 35 continues to calculate the torque needed to maintain the power called for by pedal 8 setting and calculates the necessary control values. When pedal 8 is fully released, controller 35 stops all fuel flow and disables all the cylinders until pedal 8 is again depressed or until the engine speed falls to the idle speed. When idle speed is reached, controller 35 again calculates the control values to maintain idle speed in the manner stated previously.

The following is an example of the calculations called for in the previous paragraph. A four cylinder engine is operating at 1250 revolutions per minute (RPM) with 50 foot-pounds (FP) of torque, which is a power level of 12 horsepower. Pedal 8 is depressed an amount which calls for doubling the engine power. Controller 35 calculates the required torque at 1250 rpm to be 100 FP. An engine map stored in controller 35 shows the best BSFC at 1250 RPM is at a torque of 125 FP. The drivability limit, or time between power pulses (PP), must not exceed 0.25 seconds. At 1250 RPM there are 1250/60×2 =41.7 PP per second with four cylinder, four cycle engine operation. The number of PP which may be missed and still retain good drivability is the integer of 0.25×41.7 (no fractional pulses) or 10 disabled pulses (DP). Therefore, the number of DP between PP cannot exceed 10. Computer 35 finds that 1 DP per 4 PP averages to 100 FP ((4×125=1×0)/5=100) which is within the 10 DP drivability limit, and it controls the valves to have each active cylinder fire at the lowest BSFC at all times.

Note that when the selected cylinder was disabled with the early intake valve closing previously described, the BSFC of the active cylinders would be lower than shown in the example because the energy to compress the disabled cylinder is not required and its friction is reduced. Although all the friction losses of the engine would now have to be supplied from the 3 active cylinders, the total engine friction loss is less. When additional cylinders are disabled, this advantage increases.

Note also that the example shows the DP cylinder is initially #1, then #2, and so on in a recursive manner. This provides for uniform temperature distribution in the engine. Also note that the recursive control prevents an engine unbalance from building up in amplitude when the same cylinders are disabled every revolution. Additionally, dynamic balancing is possible with computer 37 selecting the appropriate sequence of pulses.

OPERATION OF INVENTION

Figure 2:
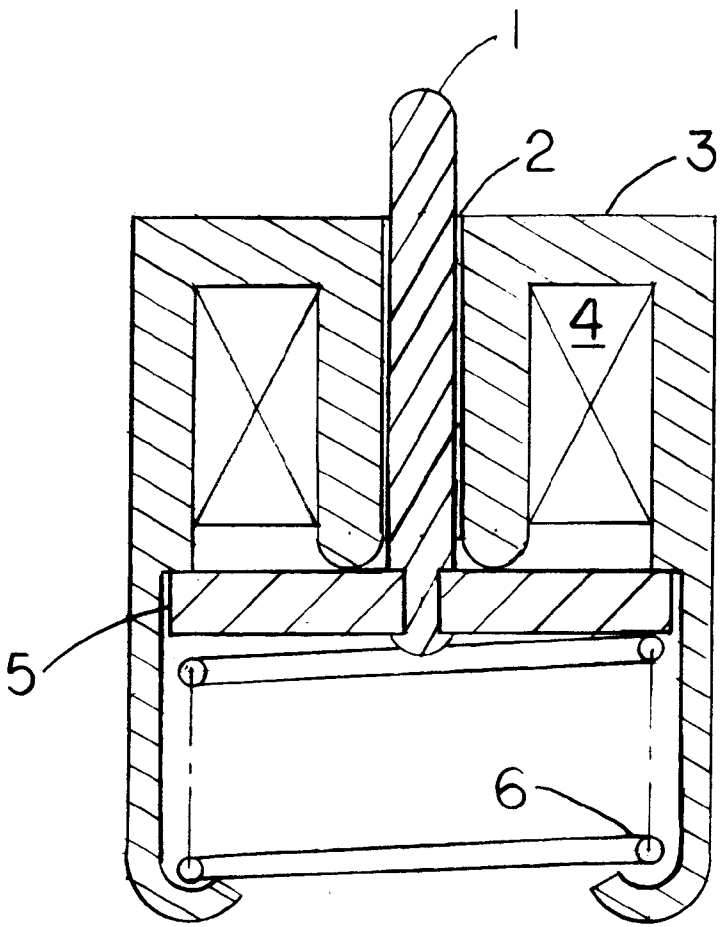
FIG. 2 is a sectional view of a cylindrical valve disabler.

Computer 37 exercises its cylinder disabling control by means of the disabler shown in cross section in FIG. 2. Disablers 22 and 25 are identical in form and operation. Stator 3 is formed of a soft magnetic material and shaped like a cylinder capped with a hollow rivet whose stem, having a rounded end is roughly one half the length of the cylinder. Sleeve bearing 2 is pressed within the center of stator 3 so as to guide pin 1 concentrically therein. Clapper 5 is a flat disc with a concentric hole and is also formed of a soft magnetic material. It is fastened concentrically to pin 1, causing clapper 5 to move concentrically within stator 3. Coil 4, which energizes the magnetic circuit, fits concentrically within stator 3. Upon coil 4 activation, clapper 5 is magnetically attracted to the rounded center portion of stator 3 and is held firmly thereto.

Spring 6 is partially compressed between clapper 5 and the rolled inward ends of stator 3, holding clapper 5 against the rounded center portion of stator 3.

As indicated in FIG. 1, disablers 22 and 25 act as fulcrums for rocker arms 28 and 30. When valve 15 is enabled as shown, coil 4 of disabler 25 is energized. This holds magnetic clapper 5 against magnetic stator 3 and the sealing force is enhanced by a rounded surface of an inner ring of cylindrical stator 3. The small contact area of the inner ring makes the flux density high so as to provide a large holding force. Disabler stator 3 is firmly held within engine head 16, and while coil 4 is energized, the end of rocker arm 30 in contact with disabler pin 1 cannot move. Thus, the full lobe force of cam 31 is directed to spring 24 and valve 15 opens.

When valve 14 is disabled as shown, coil 4 of disabler 22 is de-energized and the lobe force of cam 29 is directed to both valve spring 23 and disabler spring 6 through rocker arm 28. Since spring 6 force is less than spring 23 force even when fully depressed by cam 29 lobe , valve 14 remains closed. As spring 6 is compressed, pin 1 and clapper 5 move down. As cam 29 lobe rotates away from rocker arm 28, spring 6 pushes clapper 5 and pin 1 up until clapper 5 is stopped by stator 3.

The transition from disabled to enabled takes place when coil 4 is energized during the time the cam lobe is not in contact with the rocker arm, and no pull in force is required. The transition from enabled to disabled takes place when coil 4 is de-energized, usually while the cam lobe is depressing the rocker arm. The release of the magnetic holding force causes valve spring 24 to push up the valve end of rocker arm 30 and with a see-saw action push down pin 1 of disabler 25. At that time the valve closure rate is determined by the relative inertias of the valves, pin 1, and clapper 5 and the forces of valve spring 24 and disabler spring 6. These values are selected to give a soft landing to the valve closure.

While the description of the invention is a specific embodiment in a spark ignited engine, it is obvious that a diesel engine or hybrid engine or any other internal combustion engine would obtain many of the benefits of this invention. Therefore, the scope of this invention should be determined by the claims which follow.

Based on the forgoing description of the invention, what is claimed is:

1. A method for operating an internal combustion engine system having at least one cylinder with cam operated valves which in an enabled condition of said valves provides the means to generate a power pulse of positive torque during an engine cycle whereby said valves respond to the urging of a camshaft to admit a charge of fuel and air whose combustion will produce said power pulse and whereby said valves respond to the urging of said camshaft to provide the means to discharge the combustion products to the exhaust system, and which in a disabled condition of said valves provides the means to generate a disabled pulse of negative torque whereby said valves do not respond to the urging of said camshaft and remain closed during said engine cycle.

2. A method as defined in claim 1 wherein said disabled condition of both the intake valve and the exhaust valve begins during the piston intake stroke at a point which results in very low net gas flow across the piston rings.

3. A method as defined in claim 1 wherein said positive torques exceed said negative torques and wherein the net average torque produces the power required.

4. A method as defined in claim 3 wherein said power required is obtained with the lowest brake specific fuel consumption of said engine at any engine speed.

5. A method as defined in claim 1 wherein said negative torque due to engine friction is reduced as a result of low pneumatic spring compression in said cylinder.

6. A method as defined in claim 1 wherein said disabled pulses are combined with said power pulses as a means for obtaining uniform temperature distribution among said engine cylinders.

7. A method as defined in claim 1 wherein said disabled pulses are combined with said power pulses as a means for obtaining smooth engine operation.

8. A device having an electrically energized magnetic circuit and disabler spring for controlling at least one engine valve in an internal combustion engine so that a rotating camshaft opens and closes said valve while an electrical signal is applied to said device prior to valve action, and when said electrical signal is removed from said device, said rotating camshaft does not open and close said valve.

9. A device as defined in claim 8 wherein said magnetic circuit which is mechanically closed by said disabler spring is then held closed by electromagnetic force resulting from said electric signal during at least a part of the time when said camshaft operates said valve.

10. A device as defined in claim 9 wherein said magnetic circuit while held closed magnetically causes said valve to be operated by said camshaft, and when not held closed magnetically, said valve remains closed regardless of said camshaft action.

11. A device as defined in claim 9 wherein said electrical signal does not close said magnetic circuit.

12. A device as defined in claim 8 wherein removal of said electrical signal during said valve operation causes said valve to immediately close.

13. A device as defined in claim 8 wherein said valve is an intake valve, and early closing of said intake valve results in throttling said engine.

14. A device as defined in claim 8 wherein said valve is an exhaust valve, and early closing of said valve results in valve overlap control.

15. A device as defined in claim 9 wherein early closing of said exhaust valve results in exhaust gas recirculation control.

* * * * *